US006747641B2

(12) United States Patent
Nakamura et al.

(10) Patent No.: US 6,747,641 B2
(45) Date of Patent: Jun. 8, 2004

(54) LIQUID CRYSTAL DISPLAY DEVICE

(75) Inventors: Moritaka Nakamura, Yamatotakada (JP); Manabu Tanaka, Sakurai (JP); Yugo Kasai, Tenri (JP)

(73) Assignee: Sharp Kabushiki Kaisha, Osaka (JP)

( * ) Notice: Subject to any disclaimer, the term of this patent is extended or adjusted under 35 U.S.C. 154(b) by 252 days.

(21) Appl. No.: 09/920,384

(22) Filed: Aug. 1, 2001

(65) Prior Publication Data

US 2002/0063667 A1 May 30, 2002

(30) Foreign Application Priority Data

Aug. 4, 2000 (JP) ..... 2000-236434
Jun. 20, 2001 (JP) ..... 2001-186009

(51) Int. Cl.[7] ..... G09G 5/00
(52) U.S. Cl. ..... 345/213; 345/87; 345/99
(58) Field of Search ..... 345/87, 99, 210–215

(56) References Cited

U.S. PATENT DOCUMENTS

2002/0180673 A1 * 12/2002 Tsuda et al. ..... 345/87

FOREIGN PATENT DOCUMENTS

| | | |
|---|---|---|
| JP | H10-222134 | 8/1998 |
| JP | H11-212522 | 8/1999 |
| JP | H11-271707 | 10/1999 |

* cited by examiner

*Primary Examiner*—Kent Chang
*Assistant Examiner*—Tom Sheng
(74) *Attorney, Agent, or Firm*—Edwards & Angell, LLP; David G. Conlin; George W. Hartnell, III

(57) ABSTRACT

In a liquid crystal display device that achieves display by using an active-matrix liquid crystal panel, for a predetermined time after the driving of the liquid crystal panel is stopped, a voltage is kept applied only to the opposing electrode through which all the liquid crystal layers constituting the liquid crystal panel are driven. This helps shorten the time required for the electric charge accumulated in the liquid crystal panel to be discharged and thereby prevent degradation of display quality and deterioration of the liquid crystal panel through simple control.

8 Claims, 8 Drawing Sheets

LIQUID CRYSTAL DISPLAY DEVICE

BACKGROUND OF THE INVENTION

1. Field of the Invention

The present invention relates to a liquid crystal display device that achieves display by using an active-matrix liquid crystal panel.

2. Description of the Prior Art

Liquid crystal display devices (LCDs) find uses as displays in a variety of electronic devices and appliances for their compactness, low power consumption, and high display quality as compared with other types of display device such as cathode-ray tubes (CRTs) and plasma display panels (PDPs).

In a liquid crystal display device, when the driving of its liquid crystal panel is stopped, depending on the pattern that has been displayed thereon up to that moment, it sometimes takes an unduly long time for the electric charge accumulated in the liquid crystal panel to be discharged completely (hereinafter, this time will be referred to as the "accumulated-charge discharge time"). This not only causes an afterimage and thereby degrades display quality, but also, in some cases, leaves the electric charge accumulated in the liquid crystal panel and thereby leads to deterioration of the liquid crystal panel.

For this reason, various methods for shortening the accumulated-charge discharge time have been proposed to this date. Two of such methods will be described below. According to the first method, which applies to a transmissive liquid crystal panel, the backlight is kept lit for a predetermined time even after the driving of the liquid crystal panel has been stopped so that the accumulated-charge discharge time is shortened through the photoconductive effect of the switching devices that are connected between the liquid crystal layers of the liquid crystal panel and the signal lines.

According to the second method, as shown in FIG. 11, in the scanning electrode driving circuit 21 that drive the gates of the TFTs (thin-film transistors) connected to the liquid crystal layers of the liquid crystal panel 3, the line that supplies it with a voltage VEE for turning the TFTs off is connected through a resistor R to ground so that the accumulated-charge discharge time is shortened by the lower impedance with respect to ground.

Alternatively, as shown in FIG. 12, in the signal electrode driving circuit 22 that drives the signal lines of the liquid crystal panel 3, the lines that supply it with a plurality of voltages V1, V2, . . . , Vn are respectively connected through switches SW1, SW2, . . . , SWn and resistors R1, R2, . . . , Rn to ground, and these switches SW1, SW2, . . . , SWn are turned on when the supply of power is cut off so that the accumulated-charge discharge time is shortened by the lower impedance with respect to ground.

However, in a case where the driving of the liquid crystal panel needs to be stopped after the backlight is put out, or where the liquid crystal panel is of a reflective type and is not equipped with a backlight, the first method described above cannot be adopted but the second method described above is the only choice for the shortening of the accumulated-charge discharge time. Unfortunately, the second method cannot satisfactorily shorten the accumulated-charge discharge time, and thus cannot satisfactorily prevent the degradation of display quality and the deterioration of the liquid crystal panel.

Moreover, in the case of a liquid crystal panel provided with functions of both transmissive and reflective types (hereinafter, such a liquid crystal panel will be referred to as an "advanced liquid crystal panel"), to adopt the first method, even when the liquid crystal panel is operating in the mode in which it is driven without lighting the backlight, the backlight needs to be lit temporarily every time the driving of the liquid crystal panel is stopped.

On the other hand, other methods for shorting the accumulated-charge discharge time and methods for preventing afterimages and disturbances in the displayed image are proposed in Japanese Patent Applications Laid-Open Nos. H10-222134, H11-212522, and H11-271707. However, according to these methods, when the driving of the liquid crystal panel is stopped, it is necessary to drive the scanning lines and signal lines of the liquid crystal panel, which requires complicated control.

SUMMARY OF THE INVENTION

An object of the present invention is to provide a liquid crystal display device that prevents degradation of display quality and deterioration of its liquid crystal panel through simple control even in a case where it is impossible to shorten the accumulated-charge discharge time by the use of a backlight.

To achieve the above object, according to the present invention, in a liquid crystal display device that achieves display by using an active-matrix liquid crystal panel, for a predetermined time after the driving of the liquid crystal panel is stopped, a voltage is kept applied only to the common electrode through which all liquid crystal layers constituting the liquid crystal panel are driven.

It has been confirmed that this configuration makes it possible to shorten the accumulated-charge discharge time to a degree comparable to a method using a backlight. It has also been confirmed that, in a case where the voltage that is kept applied to the common electrode of the liquid crystal panel for the predetermined time after the driving of the liquid crystal panel is stopped is a direct-current voltage, the greater the absolute value of this voltage, and the longer the time for which this voltage is kept applied to the common electrode after the driving of the liquid crystal panel is stopped, the more the accumulated-charge discharge time is shortened. Thus, according to the present invention, it is possible to prevent degradation of display quality and deterioration of the liquid crystal panel through simple control even in a case where it is impossible to shorten the accumulated-charge discharge time by the use of a backlight.

It has also been confirmed that it is possible, when the driving of the liquid crystal panel is stopped, to shorten the accumulated-charge discharge time by shifting at least one of the timing with which to stop the supply of the signal applied to the common electrode through which all liquid crystal layers constituting the liquid crystal panel are driven and the timing with which to stop the supply of the voltage that the circuit driving the liquid crystal panel requires to turn off the switching devices of the liquid crystal panel from the timing with which to stop the supply of the other signals and electric power related to the driving of the liquid crystal panel.

BRIEF DESCRIPTION OF THE DRAWINGS

This and other objects and features of the present invention will become clear from the following description, taken in conjunction with the preferred embodiments with reference to the accompanying drawings in which.

DESCRIPTION OF THE PREFERRED EMBODIMENTS

Figure 1:
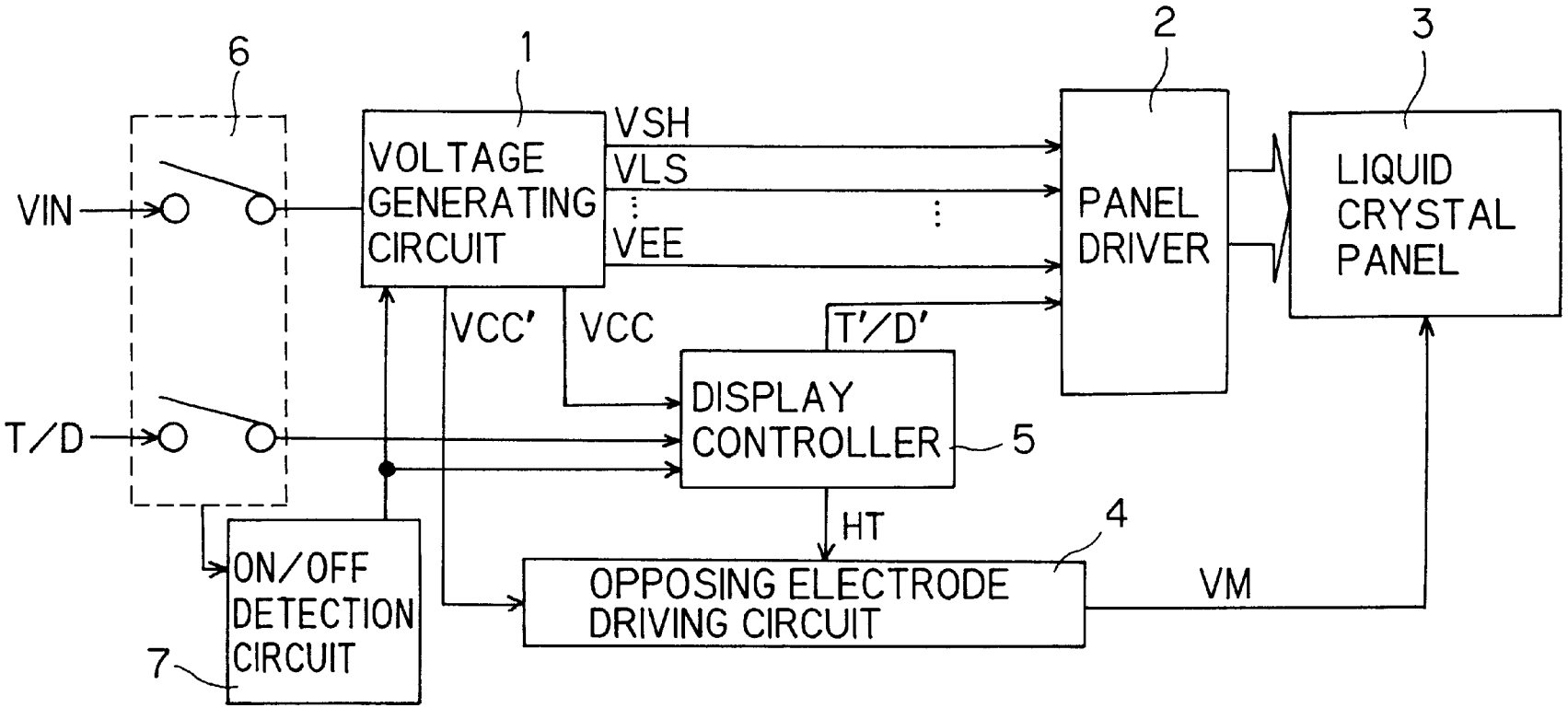
FIG. 1 is a block diagram of the liquid crystal display device of a first embodiment of the invention.

Hereinafter, embodiments of the present invention will be described with reference to the drawings. FIG. 1 shows a block diagram of the liquid crystal display device of a first embodiment of the invention. In this figure, reference numeral 1 represent a voltage generating circuit, reference numeral 2 represents a panel driver, reference numeral 3 represents an active-matrix liquid crystal panel, reference numeral 4 represents an opposing electrode driving circuit, reference numeral 5 represents a display controller, reference numeral 6 represents an external switch, and reference numeral 7 represents an on/off detection circuit.

The voltage generating circuit 1, from a voltage VIN fed thereto through the external switch 6, produces various voltages VSH, VLS, . . . , VEE, VCC, and VCC' that are needed to drive the liquid crystal panel 3. Of these voltages produced by the voltage generating circuit 1, the voltages VSH, VLS, . . . , and VEE are fed to the panel driver 2, and the voltages VCC and VCC' are respectively fed to the display controller 5 and the opposing electrode driving circuit 4. The voltage VEE serves as a supply voltage, which is needed to turn off the TFTs 31 of the liquid crystal panel 3.

Figure 2:
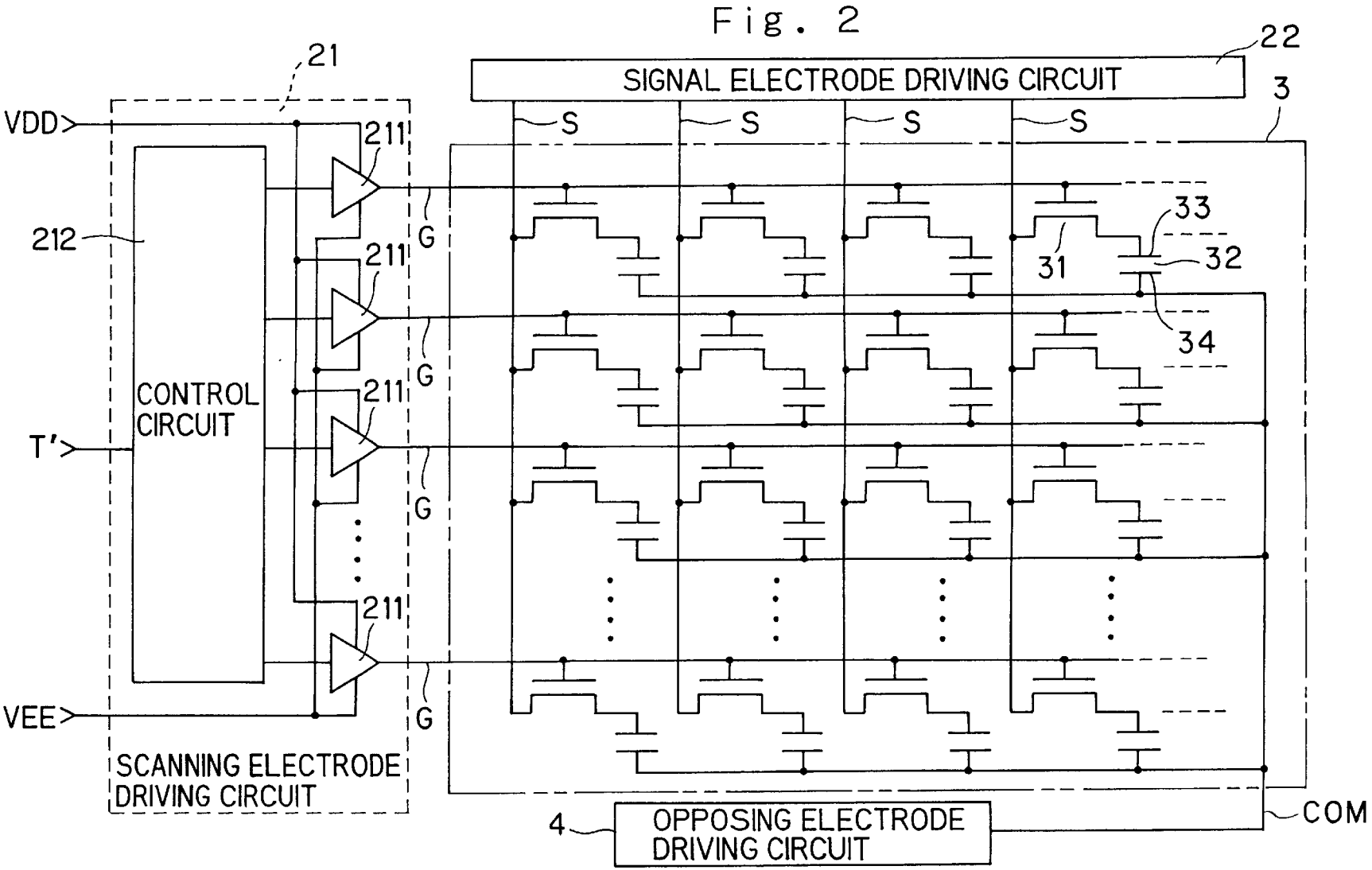
FIG. 2 is a diagram showing the configuration of the panel driver and the liquid crystal panel.

FIG. 2 shows the configuration of the panel driver 2 and the liquid crystal panel 3. First, the liquid crystal panel 3 will be described. A plurality of scanning lines G are arranged parallel to one another, and a plurality of signal lines S are arranged perpendicularly to the scanning lines G and parallel to one another. In the vicinity of each intersection among the scanning lines G and the signal lines S are provided a TFT (thin-film transistor) 31 and a liquid crystal layer 32. The gate of the TFT 31 is connected to the corresponding scanning line G. The liquid crystal layer 32 is sandwiched between two electrodes, of which one 33 (hereinafter referred to as the "signal electrode") is connected to the corresponding signal line S through the drain-source channel of the TFT 31, and of which the other 34 (hereinafter referred to as the "opposing electrode") is connected to a common line COM.

The panel driver 2 is composed of a scanning electrode driving circuit 21 and a signal electrode driving circuit 22. The scanning electrode driving circuit 21 is provided with output circuits 211, one for each of the scanning lines G of the liquid crystal panel 3, that select one of the voltages VDD and VEE fed thereto from the voltage generating circuit 1 and apply the selected voltage to the scanning lines G, and a control circuit 212 that controls those output circuits 211 in such a way that, in synchronism with a timing signal T' fed from the display controller 5, the scanning lines G of the liquid crystal panel 3 are driven one by one consecutively with the voltage VDD and the scanning lines G other than the one currently being so driven are driven with the voltage VEE.

Of all the TFTs 31, only those which have their gates connected to the scanning line G that is currently being driven with the voltage VDD by the scanning electrode driving circuit 21 are brought into a conducting state (the other TFTs 31 remain in a non-conducting state). As a result, to the signal electrodes 33 of the liquid crystal layers 32 that correspond to the scanning line G that is currently being driven with the voltage VDD by the scanning electrode driving circuit 21, the voltages with which the signal lines S are driven by the signal electrode driving circuit 22 are applied.

The signal electrode driving circuit 22, using one of the plurality of voltages fed from the voltage generating circuit 1, drives the signal lines S individually in synchronism with a timing signal T' fed from the display controller 5. The signal electrode driving circuit 22 determines which voltage to use to drive which signal on the basis of a data signal D' fed from the display controller 5.

Figure 3:
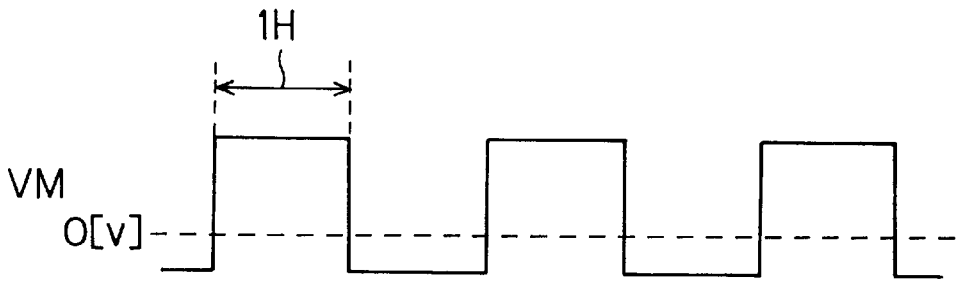
FIG. 3 is a diagram showing the waveform of the output voltage of the opposing electrode driving circuit.

The opposing electrode driving circuit 4, in synchronism with an inversion timing signal HT fed from the display controller 5, switches its output voltage VM, for example as shown in FIG. 3, between a certain positive level and a certain negative level alternately every horizontal line (H). The output voltage VM of the opposing electrode driving circuit 4 is applied to the common line COM of the liquid crystal panel 3. The opposing electrode driving circuit 4 operates from the supply voltage VCC' produced by the voltage generating circuit 1. The effective value of the output voltage VM of the opposing electrode driving circuit 4 is so set that no direct-current voltage is applied to the liquid crystal layers 32 of the liquid crystal panel 3.

The display controller 5 converts timing and data signals T/D fed thereto through the external switch 6 into signals T'/D' tailored for the panel driver 2, and feeds those signals to the panel driver 2. Moreover, the display controller 5, from the timing signal fed thereto through the external switch 6, produces an inversion timing signal HT, and feeds it to the opposing electrode driving circuit 4. The display controller 5 operates from the supply voltage VCC produced by the voltage generating circuit 1.

The external switch 6 is for choosing whether to feed the voltage VIN fed in from outside to the voltage generating circuit 1 or not and whether to feed the timing and data signals T/D fed in from outside to the display controller 5 or not.

The on/off detection circuit 7 is provided with a function of detecting that the external switch 6 is turned off, and a function of, if so, notifying the voltage generating circuit I and the display controller 5 of the fact that the external switch 6 is turned off.

When the voltage generating circuit 1 is notified, by the on/off detection circuit 7, of the fact that the external switch 6 is turned off, it stops the supply of the supply voltages VSH, VLS, . . ., VEE to the panel driver 2, but continues the supply of the supply voltage VCC' to the opposing electrode driving circuit 4 and the supply of the supply voltage VCC to the display controller 5.

The voltage generating circuit 1 is so configured that, even when the external switch 6 is turned off, i.e. even when the supply of power is cut off, it is kept supplied with power for a while so as to continue the supply of the supply voltage VCC' to the opposing electrode driving circuit 4 and the supply of the supply voltage VCC to the display controller 5 for a predetermined time. Alternatively, the on/off detection circuit 7 may be so configured as to supply power to the voltage generating circuit 1 for a predetermined time after the external switch 6 is turned off.

On the other hand, when the display controller 5 is notified, by the on/off detection circuit 7, of the fact that the external switch 6 is turned off, it stops the supply of the timing and data signals T'/D' to the panel driver 2, but continues the supply of the inversion timing signal HT to the opposing electrode driving circuit 4.

Figure 4:
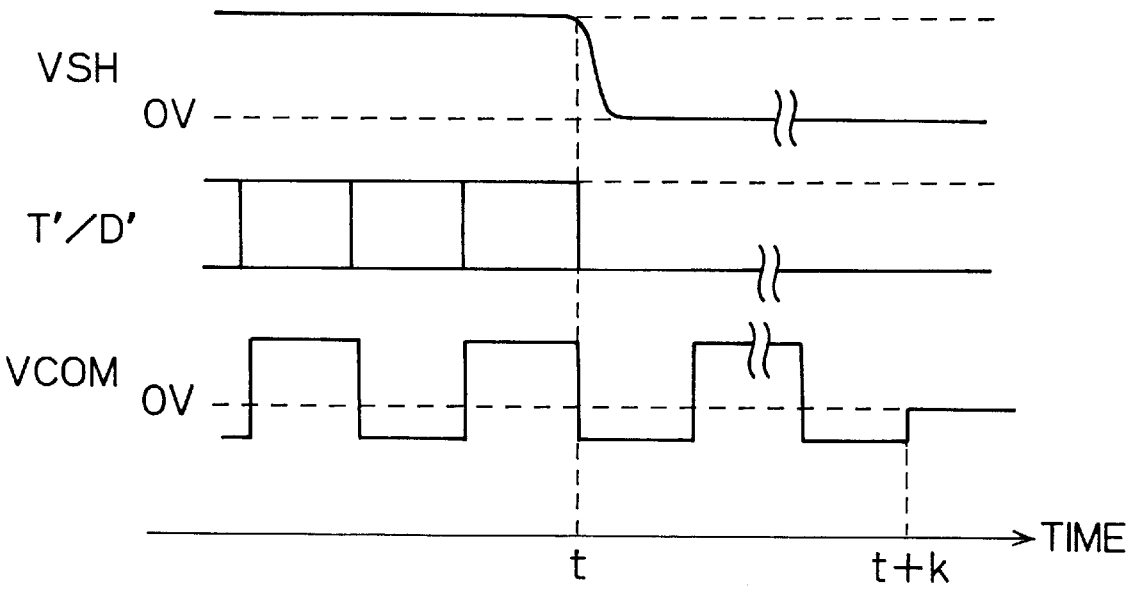
FIG. 4 is a diagram showing the voltage waveforms observed at relevant points before and after the external switch is turned off in the first embodiment.

In this configuration, as shown in FIG. 4, when the external switch 6 is turned off at a time point t, the voltages VSH, VLS, . . . , VEE fed to the panel driver 2 drop to 0 V (in the figure, only the waveform of the voltage VSH is illustrated as a representative), and the timing and data signals T'/D' fed to the panel driver 2 become blank. Thus, the driving of the liquid crystal panel 3 is stopped. However, as the waveform marked VCOM shows the voltage applied to the opposing electrode 34 of the liquid crystal panel 3, the voltage VM output from the opposing electrode driving circuit 4 is kept applied to the opposing electrode 34 of the liquid crystal panel 3. Then, a predetermined time k after the external switch 6 is turned off, this voltage VCOM applied to the opposing electrode of the liquid crystal panel 3 also drops to 0 V.

In this way, in the first embodiment, the voltage applied to the opposing electrode of the liquid crystal panel when it is driven (i.e. a signal that inverts at regular time intervals) is kept applied only to the opposing electrode of the liquid crystal panel for a predetermined time even after the driving of the liquid crystal panel has been stopped. It has been confirmed through experiments that this makes it possible to shorten the accumulated-charge discharge time to a degree comparable to a method using a backlight (as in a case where the backlight is put out after the driving of the liquid crystal panel is stopped) and thereby prevent degradation of display quality and deterioration of the liquid crystal panel.

Table 1 shows the results of experiments conducted under the following conditions: 640 horizontal display lines, 240 vertical display lines, striped arrangement, normally white, a 12.6 MHz master oscillation clock, 15.75 kHz horizontal periods, 60 Hz vertical periods, and a solid black display pattern (the state in which the largest amount of electric charge is accumulated in the liquid crystal panel). These experiments were conducted, in a case where the signal applied to the opposing electrode of the liquid crystal panel is inverted every horizontal line, by the inventors subjectively evaluating whether the obtained display quality is good, fair, or poor while varying, as the parameter, the difference between the timing with which the supply of the signal applied to the opposing electrode is stopped and the timing with which the supply of the other signals and electric power related to the driving of the liquid crystal panel is stopped (in Table 1, a negative value indicates that the supply of the signal applied to the opposing electrode was stopped before the supply of the other signals and electric power was stopped, and a positive value indicates that the former was stopped after the latter was stopped).

The results of the experiments show that, under the conditions under which they were conducted, it is possible to shorten the accumulated-charge discharge time to such a degree as to obtain acceptable display quality by stopping the supply of the signal applied to the opposing electrode about 15 ms or longer after stopping the supply of the other signals and electric power related to the driving of the liquid crystal panel.

It has been confirmed through experiments that it is also possible, by stopping the supply of the signal applied to the opposing electrode before stopping the supply of the other signals and electric power, to shorten the accumulated-charge discharge time to a degree comparable to a method using a backlight. In this case, however, the discharge of the electric charge accumulated in the liquid crystal panel is started after the supply of the other signals and electric power is stopped, and therefore the image that is displayed after the supply of the signal applied to the opposing electrode is stopped until the supply of the other signals and electric power is stopped appears brighter as a whole, degrading display quality. For this reason, the method of stopping the supply of the signal applied to the opposing electrode before stopping the supply of the other signals and electric power is considered to be effective only when used for the purpose of preventing the deterioration of the liquid crystal panel.

Figure 5:
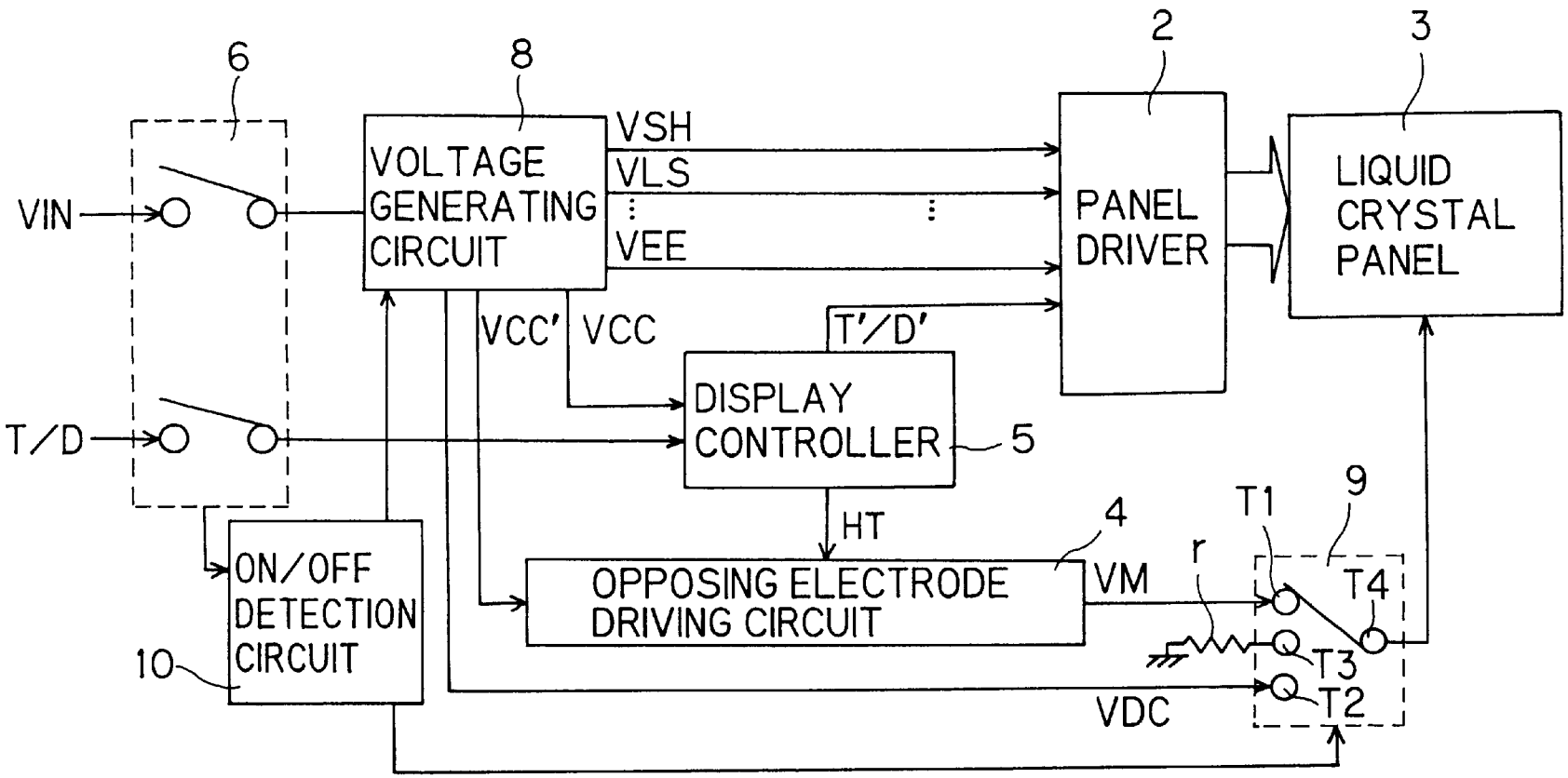
FIG. 5 a block diagram of the liquid crystal display device of a second embodiment of the invention.

FIG. 5 shows a block diagram of the liquid crystal display device of a second embodiment of the invention. In this figure, reference numeral 8 represents a voltage generating circuit, reference numeral 9 represents an opposing electrode driving voltage selecting switch, and reference numeral 10 represents an on/off detection circuit. Here, such circuit blocks and elements as are found also in the block diagram of the first embodiment are identified with the same reference numerals, and their explanations will not be repeated.

The voltage generating circuit 8, from a voltage VIN fed thereto through the external switch 6, produces various voltages VSH, VLS, . . . , VEE, VCC, and VCC' that are needed to drive the liquid crystal panel 3, and also produces a predetermined direct-current voltage VDC. Of these voltages produced by the voltage generating circuit 8, the voltages VSH, VLS, . . . , and VEE are fed to the panel driver 2, the voltages VCC and VCC' are respectively fed to the display controller 5 and the opposing electrode driving circuit 4, and the direct-current voltage VDC is fed to a terminal T2 of the opposing electrode driving voltage selecting switch 9.

The opposing electrode driving voltage selecting switch 9 has four terminals T1, T2, T3, and T4, and is so configured as to perform switching in such a way that one of the paths between its terminals T1 and T4, T2 and T4, and T3 and T4 conducts at a time. The opposing electrode driving voltage selecting switch 9 receives at its terminal T1 the output voltage VM of the opposing electrode driving circuit 4, receives at its terminal T2 the voltage VDC output from the voltage generating circuit 8, has its terminal T3 grounded through a resistor r, and has its terminal T4 connected to the common line COM of the liquid crystal panel 3.

The on/off detection circuit 10 is provided with a function of detecting that the external switch 6 is turned on, a function of, when the external switch 6 is turned on, switching the opposing electrode driving voltage selecting switch 9 so that the path between its terminals T1 and T4 conducts, a function of detecting that the external switch 6 is turned off, a function of notifying the voltage generating circuit 8 of the fact that the external switch 6 is turned off, a function of, when the external switch 6 is turned off, switching the opposing electrode driving voltage selecting switch 9 so that the path between its terminals T2 and T4 conducts, and a function of, a predetermined time after the external switch 6 is turned off, switching the opposing electrode driving voltage selecting switch 9 so that the path between its terminals T3 and T4 conducts.

When the voltage generating circuit 8 is notified, by the on/off detection circuit 10, of the fact that the external switch 6 is turned off, it stops the supply of the voltages VSH, VLS, . . . , VEE to the panel driver 2, the supply of the supply voltage VCC' to the opposing electrode driving circuit 4, and the supply of the supply voltage VCC to the display controller 5, but continues the output of the direct-current voltage VDC.

The voltage generating circuit 8 is so configured that, even when the external switch 6 is turned off, i.e. even when the supply of power is cut off, it is kept supplied with power for a while so as to continue the output of the direct-current voltage VDC for a predetermined time. Alternatively, the on/off detection circuit 10 may be so configured as to supply power to the voltage generating circuit 8 for a predetermined time after the external switch 6 is turned off.

It is also possible to omit the terminal T3 of the opposing electrode driving voltage selecting switch 9, and accordingly omit the function, provided for the on/off detection circuit 10, of switching the opposing electrode driving voltage selecting switch 9 so that the path between its terminals T3 and T4 conducts a predetermined time after the external switch 6 is turned off. Even in this case, a predetermined time after the external switch 6 is turned off, the direct-current voltage output from the voltage generating circuit 8 drops to 0 V, ultimately achieving the same operation.

Figure 6:
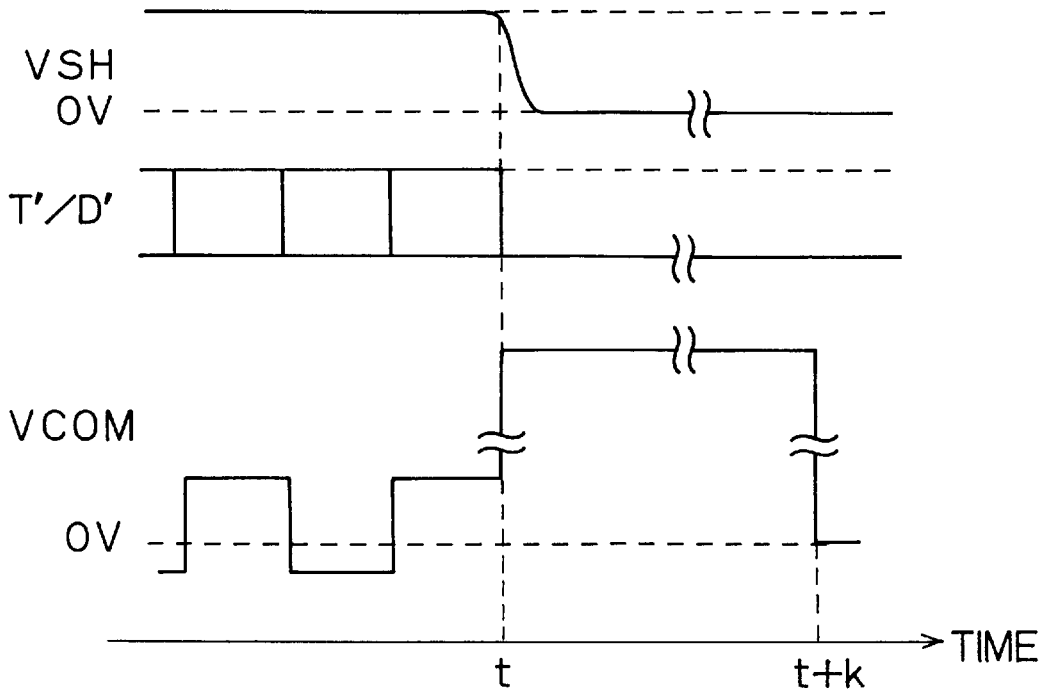
FIG. 6 is a diagram showing an example of the voltage waveforms observed at relevant points before and after the external switch is turned off in the second embodiment.

In this configuration, as shown in FIG. 6, when the external switch 6 is turned off at a time point t, the voltages VSH, VLS, . . ., VEE fed to the panel driver 2 drop to 0 V (in the figure, only the waveform of the voltage VSH is illustrated as a representative), and the timing and data signals T'/D' fed to the panel driver 2 become blank. Thus, the driving of the liquid crystal panel 3 is stopped. However, as the waveform marked VCOM shows the voltage applied to the opposing electrode 34 of the liquid crystal panel 3, the direct-current voltage VDC output from the voltage generating circuit 8 is kept applied to the opposing electrode 34 of the liquid crystal panel 3. Then, a predetermined time k after the external switch 6 is turned off, this voltage VCOM applied to the opposing electrode of the liquid crystal panel 3 also drops to 0 V.

Figure 7:
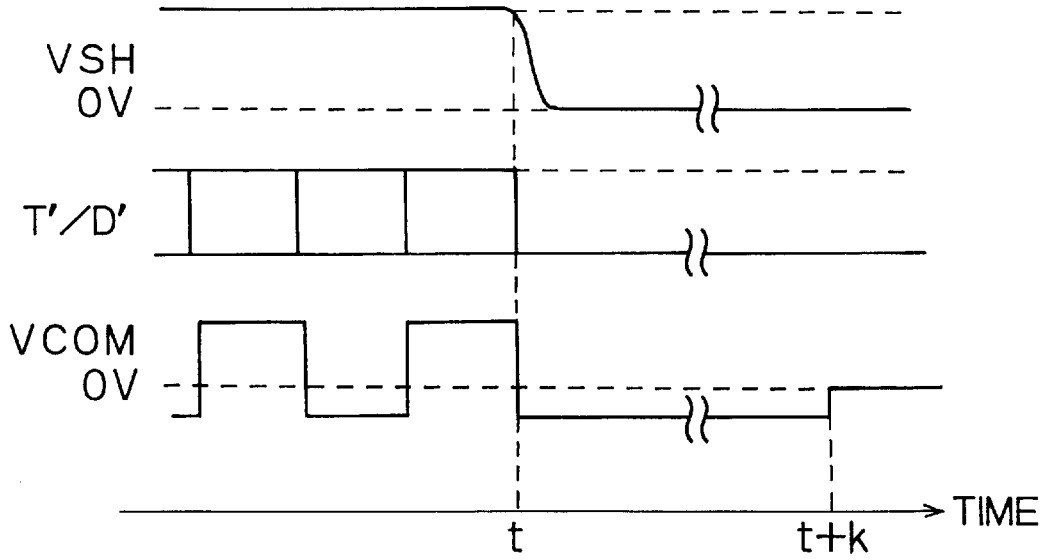
FIG. 7 is a diagram showing another example of the voltage waveforms observed at relevant points before and after the external switch is turned off in the second embodiment.

FIG. 6 corresponds to a case where the direct-current voltage VDC output from the voltage generating circuit 8 is positive. The direct-current voltage VDC output from the voltage generating circuit 8 may be negative, in which case the waveforms are as shown in FIG. 7.

In this way, in the second embodiment, the direct-current voltage is kept applied only to the opposing electrode of the liquid crystal panel for a predetermined time even after the driving of the liquid crystal panel has been stopped. It has been confirmed through experiments that, by appropriately setting the magnitude and duration of the direct-current voltage that is applied to the opposing electrode after the driving of the liquid crystal panel is stopped, it is possible to shorten the accumulated-charge discharge time to a degree greater than by a method using a backlight (as in a case where the backlight is put out after the driving of the liquid crystal panel is stopped).

The accumulated-charge discharge time depends on the absolute value of the direct-current voltage that is kept applied to the opposing electrode even after the driving of the liquid crystal panel has been stopped and on the time for which that direct-current voltage is kept applied thereto (hereinafter, this time will be referred to as the "delay period"). Specifically, the greater the absolute value of the direct-current voltage, the faster the accumulated electric charge is discharged, which makes the delay period required to achieve the same accumulated-charge discharge time shorter.

Figure 8:
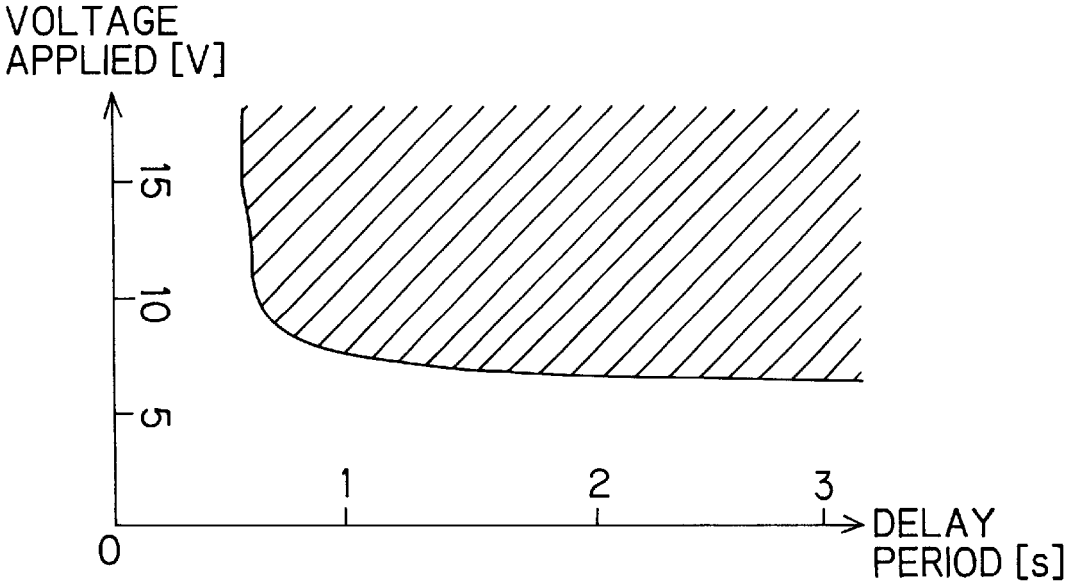
FIG. 8 is a diagram showing the results of experiments conducted, in a case where a positive direct-current voltage is applied to the opposing electrode of the liquid crystal panel after its driving is stopped, to determine the combinations of the magnitude and duration of the voltage applied that make the accumulated-charge discharge time shorter than in a case where the backlight is put out after the driving of the liquid crystal panel is stopped.
Figure 9:
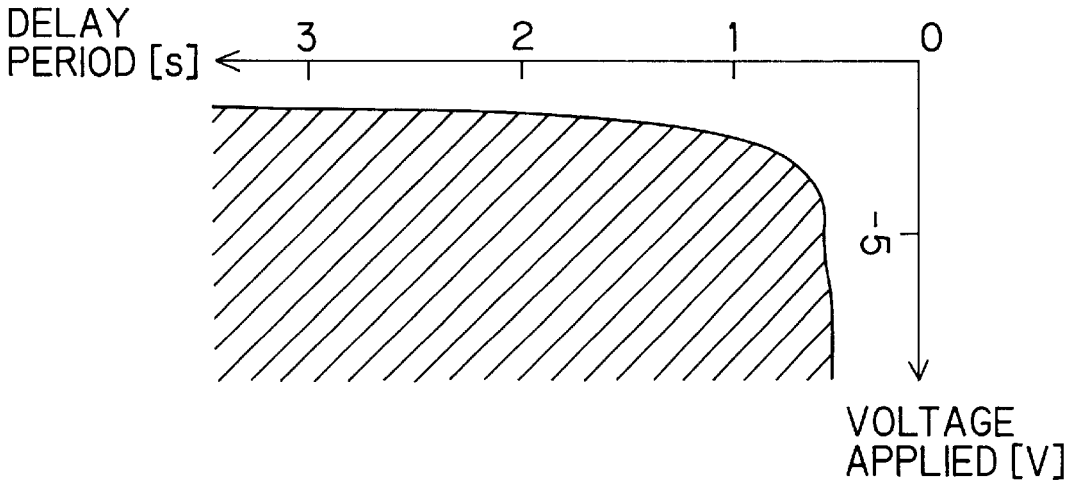
FIG. 9 is a diagram showing the results of experiments conducted, in a case where a negative direct-current voltage is applied to the opposing electrode of the liquid crystal panel after its driving is stopped, to determine the combinations of the magnitude and duration of the voltage applied that make the accumulated-charge discharge time shorter than in a case where the backlight is put out after the driving of the liquid crystal panel is stopped.

It has been confirmed through experiments that, to shorten the accumulated-charge discharge time to a degree greater than by using a backlight, the absolute value of the direct-current voltage that is kept applied to the opposing electrode even after the driving of the liquid crystal panel has been stopped needs to be 7 V or higher, if the direct-current voltage is positive, or 2 V or higher, if it is negative. In FIG. 8 (with a positive voltage) and FIG. 9 (with a negative voltage), the hatched area indicates the region corresponding to the combinations of the magnitude of the direct-current voltage and the delay period that make the accumulated-charge discharge time shorter than by using a backlight in a liquid crystal panel of a given size.

It has also been confirmed through experiments that, in a liquid crystal panel of a given size, to shorten the accumulated-charge discharge time to a degree greater than by using a backlight, the delay time needs to be about 2 to 3 s, if the direct-current voltage is 8 V, or about 1 to 1.5 s, if it is 10 V, or about 1.5 to 2 s, if it is −3 V, or about 1 to 1.5 s, if it is −5 V, or about 0.5 s, if it is −10 V.

In short, in the liquid crystal display devices of the first and second embodiments described above, it is possible, even without using a backlight, to shorten the accumulated-charge discharge time to a degree greater than by using a backlight. Thus, even with a reflective liquid crystal panel that is not equipped with a backlight, or with an advanced liquid crystal panel that may operate in a mode in which it is driven without lighting a backlight, or in a case where the driving of the liquid crystal panel needs to be stopped after the backlight is put out, it is possible to prevent degradation of display quality and deterioration of the liquid crystal panel. Moreover, this is achieved simply by applying a voltage only to the opposing electrode of the liquid crystal panel for a predetermined time after the driving of the liquid crystal panel is stopped, and thus without using complicated control.

Figure 10:
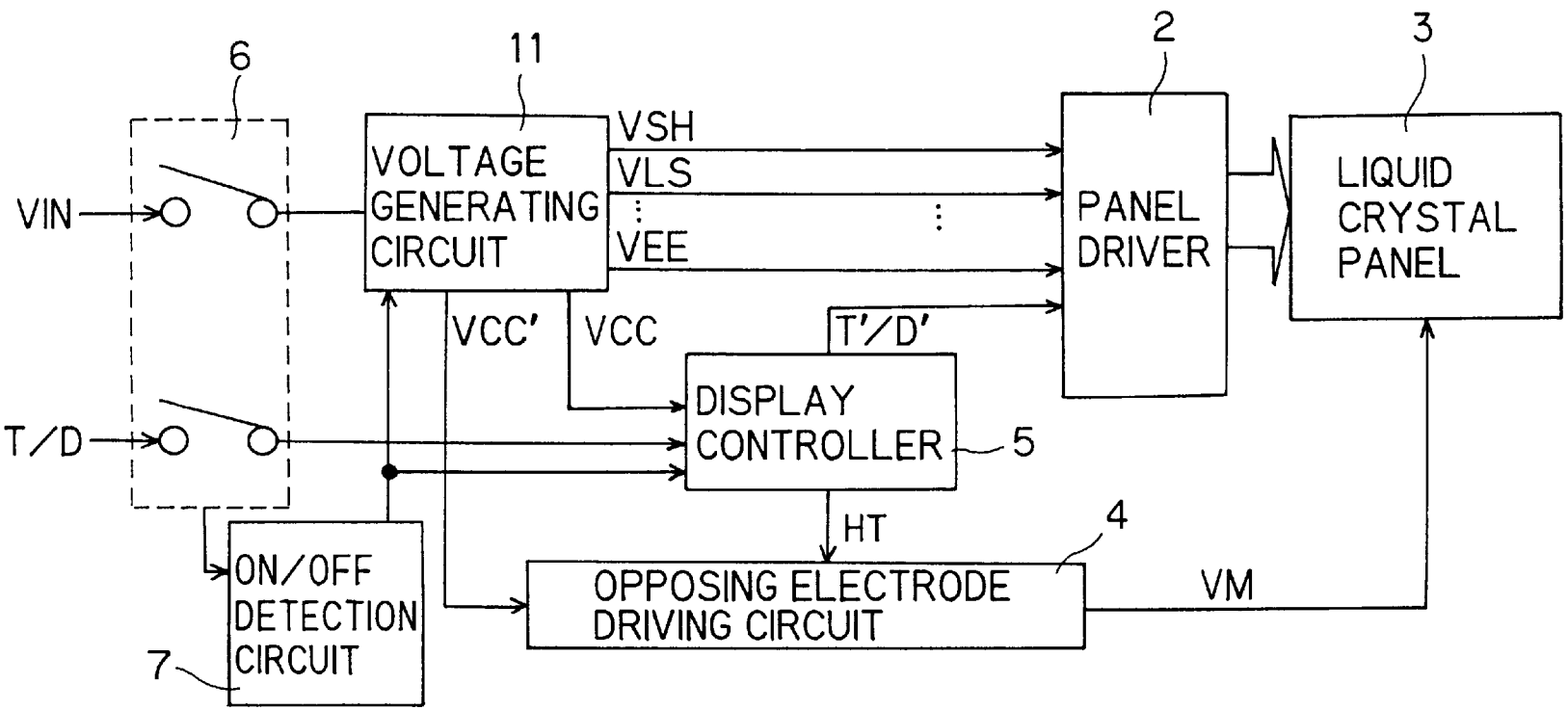
FIG. 10 is a block diagram of the liquid crystal display device of a third embodiment of the invention.
Figure 11:
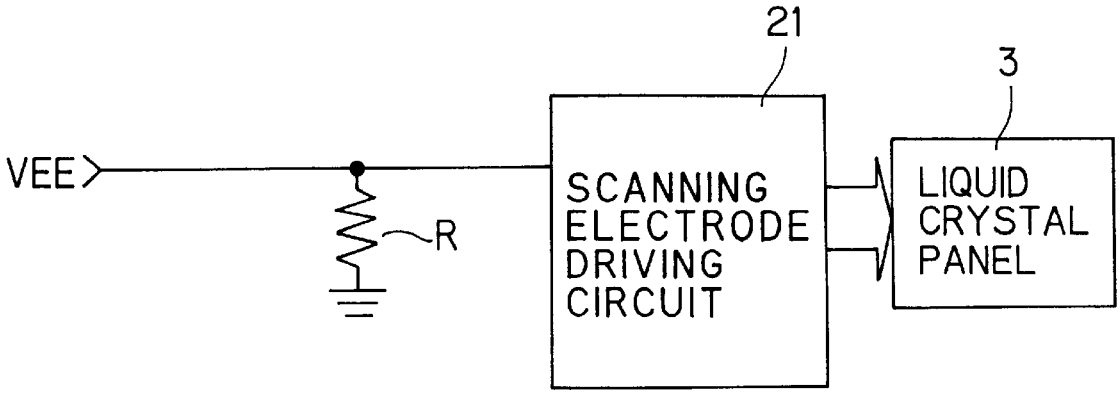
Fig. 11 PRIOR ART
FIG. 11 is a diagram showing an example of a configuration adopted to shorten the accumulated-charge discharge time in a conventional liquid crystal display device.
Figure 12:
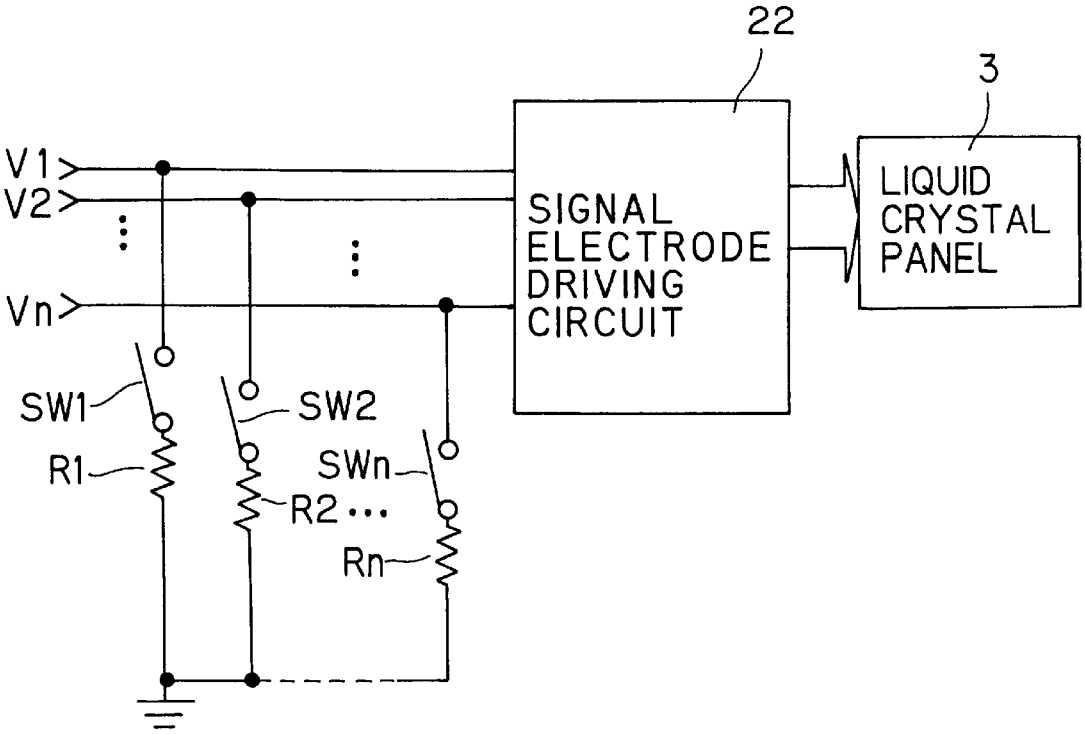
Fig. 12 PRIOR ART
FIG. 12 is a diagram showing another example of a configuration adopted to shorten the accumulated-charge discharge time in a conventional liquid crystal display device.

FIG. 10 shows a block diagram of the liquid crystal display device of a third embodiment of the invention. In this figure, reference numeral 11 represents a voltage generating circuit. Here, such circuit blocks and elements as are found also in the block diagram of the first embodiment are identified with the same reference numerals, and their explanations will not be repeated.

The voltage generating circuit 11, from a voltage VIN fed thereto through the external switch 6, produces various voltages VSH, VLS, . . . , VEE, VCC, and VCC' that are needed to drive the liquid crystal panel 3. Of these voltages produced by the voltage generating circuit 11, the voltages VSH, VLS, . . . , and VEE are fed to the panel driver 2, and the voltages VCC and VCC' are respectively fed to the display controller 5 and the opposing electrode driving circuit 4.

When the voltage generating circuit 11 is notified, by the on/off detection circuit 7, of the fact that the external switch 6 is turned off, it stops the supply of the voltages to the panel driver 2 except the voltage VEE, but continues the supply of the voltage VEE to the panel driver 2, the supply of the supply voltage VCC' to the opposing electrode driving circuit 4, and the supply of the supply voltage VCC to the display controller 5.

The voltage generating circuit 11 is so configured that, even when the external switch 6 is turned off, i.e. even when the supply of power is cut off, it is kept supplied with power for a while so as to continue the supply of the voltage VEE to the panel driver 2, the supply of the supply voltage VCC' to the opposing electrode driving circuit 4, and the supply of the supply voltage VCC to the display controller 5 for a predetermined time. Alternatively, the on/off detection circuit 7 may be so configured as to supply power to the voltage generating circuit 11 for a predetermined time after the external switch 6 is turned off.

Thus, in the liquid crystal display device of the third embodiment, when the external switch 6 is turned off, the voltages fed to the panel driver 2 drop to 0 V except the voltage VEE, and the timing and data signals T'/D' fed to the panel driver 2 become blank. Thus, the driving of the liquid crystal panel 3 is stopped. However, a voltage signal that inverts every horizontal line is kept applied to the opposing electrode 34 of the liquid crystal panel 3, and the voltage VEE is kept fed to the panel driver 2 for a predetermined time.

As a result, at the time point when the supply of the signals and electric power, other than the voltage VEE fed to the panel driver 2 and the signal applied to the opposing electrode 34 of the liquid crystal panel 3, is stopped, the discharge of the electric charge accumulated in the liquid crystal panel 3 is started. Here, it has been confirmed through experiments that, by appropriately setting the difference between the timing with which the supply of the signal applied to the opposing electrode 34 and of the voltage VEE is stopped and the timing with which the supply of the other signals and electric power related to the driving of the liquid crystal panel is stopped, it is possible to shorten the accumulated-charge discharge time to a degree comparable to a method using a backlight (as in a case where the backlight is put out after the driving of the liquid crystal panel is stopped) and thereby prevent degradation of display quality and deterioration of the liquid crystal panel.

It is also possible to stop the supply of the signal applied to the opposing electrode of the liquid crystal panel and of the voltage VEE to the panel driver before stopping the supply of the other signals and electric power related to the driving of the liquid crystal panel. In this case, at the time point when the supply of the signal applied to the opposing electrode and of the voltage VEE is stopped, the discharge of the electric charge accumulated in the liquid crystal panel is started. Here also, it has been confirmed through experiments that, by appropriately setting the difference between the timing with which the supply of the signal applied to the opposing electrode and of the voltage VEE is stopped and the timing with which the supply of the other signals and electric power is stopped, it is possible to shorten the accumulated-charge discharge time to a degree comparable to a method using a backlight and thereby prevent degradation of display quality and deterioration of the liquid crystal panel.

Through experiments, it has been confirmed that, in a case where the timing with which the supply of the signal applied to the opposing electrode of the liquid crystal panel and of the voltage VEE to the panel driver is stopped is shifted from the timing with which the supply of the other signals and electric power related to the driving of the liquid crystal panel is stopped, the difference in timing that is required to shorten the accumulated-charge discharge time to such a degree as to obtain acceptable display quality is shorter than in a case where only the timing with which the supply of the signal applied to the opposing electrode of the liquid crystal panel is stopped is shifted. However, due to the resolution of the testing equipment used, it was impossible to confirm the minimum difference in timing that permits the accumulated-charge discharge time to be shortened to such a degree as to obtain acceptable display quality.

It is also possible to stop only the supply of the voltage VEE to the panel driver after stopping the supply of the other signals and electric power related to the driving of the liquid crystal panel. In this case, at the time point when the supply of the voltage VEE is stopped, the discharge of the electric charge accumulated in the liquid crystal panel is started. Here, it has been confirmed through experiments that, by appropriately setting the difference between the timing with which the supply of the voltage VEE is stopped and the timing with which the supply of the other signals and electric power is stopped, it is possible to shorten the accumulated-charge discharge time to a degree comparable to a method using a backlight (as in a case where the backlight is put out after the driving of the liquid crystal panel is stopped) and thereby prevent degradation of display quality and deterioration of the liquid crystal panel.

On the other hand, it has also been confirmed through experiments that it is possible, by stopping the supply of the voltage VEE to the panel driver before stopping the supply of the other signals and electric power related to the driving of the liquid crystal panel, to shorten the accumulated-charge discharge time to a degree comparable to a method using a backlight. In this case, however, the discharge of the electric charge accumulated in the liquid crystal panel is started after the supply of the other signals and electric power is stopped, and therefore the image that is displayed after the supply of the voltage VEE is stopped until the supply of the other signals and electric power is stopped appears whitish as a whole, degrading display quality. For this reason, the method of stopping the supply of the voltage VEE before stopping the supply of the other signals and electric power is considered to be effective only when used for the purpose of preventing the deterioration of the liquid crystal panel.

Through experiments, it has been confirmed that, in a case where only the timing with which the supply of the voltage VEE to the panel driver is stopped is shifted from the timing with which the supply of the other signals and electric power related to the driving of the liquid crystal panel is stopped, the difference in timing that is required to shorten the accumulated-charge discharge time to such a degree as to obtain acceptable display quality is shorter than in a case where only the timing with which the supply of the signal applied to the opposing electrode of the liquid crystal panel is stopped is shifted. However, due to the resolution of the testing equipment used, it was impossible to confirm the minimum difference in timing that permits the accumulated-charge discharge time to be shortened to such a degree as to obtain acceptable display quality.

Here, i.e. in a case where the timing with which the supply of the voltage VEE to the panel driver is stopped is shifted from the timing with which the supply of the other signals and electric power related to the driving of the liquid crystal panel is stopped, it is essential to give consideration to the sequence covering also other supply voltages used in the scanning electrode driving circuit provided within the panel driver, because failing to do so means failing to comply with the requirements of the scanning electrode driving circuit and thus leads to destruction thereof. To prevent this, it is necessary to devise a circuit configuration with consideration given to the sequence involving the circuits around with respect to the timing with which the supply of relevant signals is stopped. This requires narrower tolerance ranges, and thus higher accuracy in the components used. As a result, it is inevitable to adopt a complicated circuit configuration, possibly at extra cost.

Accordingly, in preventing the degradation of display quality and the deterioration of the liquid crystal panel by shortening the accumulated-charge discharge time of the liquid crystal panel when its driving is stopped, from a viewpoint of avoiding a complicated circuit configuration and higher cost, it is preferable to adopt the method of delaying only the timing with which the supply of the signal applied to the opposing electrode is stopped from the timing with which the supply of the other signals and electric power is stopped.

The liquid crystal display devices of the embodiments described hereinbefore can be used as displays in a variety of electronic devices and appliances, such as car navigation systems, subsidiary meter panels for cars, cellular phones, portable game machines, portable television receivers, notebook personal computers, and portable digital assistants.

TABLE 1

| Difference in Timing | Evaluation |
|---|---|
| −5.3 s | poor |
| −2.1 s | poor |
| −1.2 s | poor |
| −10.5 ms | poor |
| 0 (simultaneous) | poor |
| +2.2 ms | fair |

TABLE 1-continued

| Difference in Timing | Evaluation |
|---|---|
| +7.3 ms | fair |
| +10.4 ms | fair |
| +14.9 ms | good |
| +20.4 ms | good |
| +103 ms | good |
| +1.1 s | good |
| +2.3 s | good |
| +5.4 s | good |

Evaluation:
good: satisfactory image quality
fair: largely satisfactory image quality, only slightly flawed
poor: poor image quality, unacceptably flawed

What is claimed is:

1. A liquid crystal display device that achieves display by using an active-matrix liquid crystal panel, said active-matrix liquid crystal panel comprising a plurality of signal electrodes and a plurality of gate electrodes, wherein, for a predetermined time after driving of said plurality of signal electrodes and said plurality of said gate electrodes, data signals to said plurality of signal electrodes and said plurality of gate electrodes of the liquid crystal panel are stopped, a voltage is kept applied only to an opposing electrode through which all liquid crystal cells constituting the liquid crystal panel are driven, said voltage being equal to a voltage that is applied to the opposing electrode when the liquid crystal panel is being driven.

2. A liquid crystal display device as claimed in claim 1, wherein the voltage that is applied to the opposing electrode after the driving of said plurality of signal electrodes and said plurality of gate electrodes of the liquid crystal panel is stopped is maintained for about 15 ms or longer.

3. A liquid crystal display device as claimed in claim 1, wherein the voltage applied to the opposing electrode that is maintained for the predetermined time after the driving of said plurality of signal electrodes and said plurality of gate electrodes of the liquid crystal panel is stopped is a direct-current voltage.

4. A liquid crystal display device as claimed in claim 3, wherein the direct-current voltage is a positive voltage.

5. A liquid crystal display device as claimed in claim 3, wherein the direct-current voltage is a negative voltage.

6. A liquid crystal display device as claimed in claim 1, wherein the liquid crystal panel is of a reflective type.

7. A liquid crystal display device as claimed in claim 1, wherein the liquid crystal panel is provided with functions of both transmissive and reflective types.

8. A liquid crystal display device that achieves display by using an active-matrix liquid crystal panel, wherein, when driving of the liquid crystal panel is stopped, timing with which to stop supply of a signal applied to an opposing electrode through which all liquid crystal cells constituting the liquid crystal panel are driven and timing with which to stop supply of a plurality of driving voltages that a circuit driving the liquid crystal panel requires to turn off switching devices of the liquid crystal panel are shifted from timing with which to stop supply of all other driving signals and electric power voltages related to the driving of the liquid crystal panel exclusive of said timing signal applied to an opposing electrode and said timing voltage required to turn off switching devices.

* * * * *